US010738521B2

(12) United States Patent
Hamilton et al.

(10) Patent No.: US 10,738,521 B2
(45) Date of Patent: Aug. 11, 2020

(54) SLIDING DOOR ROLLER SYSTEM

(71) Applicant: Interlock USA, Inc., Reno, NV (US)

(72) Inventors: Trudi Anne Hamilton, Auckland (NZ); Duncan Duff McGregor, Auckland (NZ); Nolan Lloyd Couzyn, Auckland (NZ)

(73) Assignee: Interlock USA, Inc., Reno, NV (US)

( * ) Notice: Subject to any disclaimer, the term of this patent is extended or adjusted under 35 U.S.C. 154(b) by 141 days.

(21) Appl. No.: 15/940,495

(22) Filed: Mar. 29, 2018

(65) Prior Publication Data

US 2018/0283070 A1 Oct. 4, 2018

Related U.S. Application Data

(60) Provisional application No. 62/478,343, filed on Mar. 29, 2017.

(51) Int. Cl.
*E05D 15/06* (2006.01)

(52) U.S. Cl.
CPC ..... *E05D 15/0634* (2013.01); *E05D 15/0669* (2013.01); *E05Y 2201/10* (2013.01); *E05Y 2201/638* (2013.01); *E05Y 2201/688* (2013.01); *E05Y 2600/528* (2013.01); *E05Y 2800/268* (2013.01); *E05Y 2800/29* (2013.01); *E05Y 2900/148* (2013.01)

(58) Field of Classification Search
CPC ..... E05D 15/0634; E05D 15/0669
See application file for complete search history.

(56) References Cited

U.S. PATENT DOCUMENTS

| | | | | |
|---|---|---|---|---|
| 215,993 | A * | 5/1879 | Townsend | E05D 15/0669 16/100 |
| 2,494,347 | A | 1/1950 | Matthews | |
| 3,237,238 | A * | 3/1966 | Anderson | E05D 15/0669 16/105 |
| 3,443,340 | A | 5/1969 | Helmick et al. | |
| 3,996,643 | A | 12/1976 | Steigerwald | |
| 4,134,178 | A | 1/1979 | Stevens | |

(Continued)

FOREIGN PATENT DOCUMENTS

| | | |
|---|---|---|
| CA | 2350051 A1 | 6/2001 |
| CA | 2435502 A1 | 7/2003 |

(Continued)

*Primary Examiner* — Victor D Batson
*Assistant Examiner* — Matthew J Sullivan
(74) *Attorney, Agent, or Firm* — DeLio Peterson & Curcio LLC; David R. Pegnataro

(57) ABSTRACT

A sliding door roller system comprises a roller housing comprising a pair of generally vertical side members and an integral base portion including a projection on an inner surface thereof, the roller housing at least partially disposed within an outer housing; at least one roller wheel rotatably coupled to the roller housing; an outer housing moveable relative to the roller housing and the at least one roller wheel in a direction perpendicular to a rotational axis of the at least one roller wheel; and a rotatable adjustment mechanism coupled to the roller housing and the outer housing. The adjustment mechanism is rotatable from an exterior of the outer housing and is adapted to index the outer housing relative to the roller housing in a plurality of height positions in situ under load of a panel secured to the outer housing.

18 Claims, 11 Drawing Sheets

(56) References Cited

U.S. PATENT DOCUMENTS

| | | | | |
|---|---|---|---|---|
| 4,194,266 | A * | 3/1980 | Natzel | E05D 15/0669 16/32 |
| 6,021,547 | A | 2/2000 | Stagoll | |
| 6,526,625 | B2 | 3/2003 | Becken | |
| 6,588,061 | B2 | 7/2003 | Becken | |
| 7,770,329 | B2 * | 8/2010 | Hutnik | E05D 15/0669 49/410 |
| 7,962,998 | B2 | 6/2011 | Proctor et al. | |
| 8,881,460 | B2 | 11/2014 | Bouthillier | |
| 8,950,041 | B2 * | 2/2015 | Palsson | E05D 15/0634 16/102 |
| 8,955,195 | B2 * | 2/2015 | Chang | E05D 15/0639 16/91 |
| 8,984,716 | B2 | 3/2015 | Proctor et al. | |
| 9,068,385 | B2 | 6/2015 | Proctor et al. | |
| 9,080,359 | B2 | 7/2015 | Horwood | |
| 9,085,924 | B2 * | 7/2015 | Tidwell | E05D 15/0669 |
| 9,458,654 | B2 * | 10/2016 | Palsson | E05D 15/0634 |
| 2005/0011041 | A1 * | 1/2005 | Ness | E05D 15/0669 16/105 |
| 2005/0012816 | A1 * | 1/2005 | Becken | E05D 15/0665 348/107 |
| 2007/0017065 | A1 | 1/2007 | Hutnik et al. | |
| 2014/0173991 | A1 | 6/2014 | Saunders et al. | |
| 2016/0138315 | A1 * | 5/2016 | Kreyenborg | E05D 15/0647 49/409 |

FOREIGN PATENT DOCUMENTS

| | | | |
|---|---|---|---|
| CA | 2615240 | A1 | 1/2007 |
| CA | 2835580 | A1 | 6/2014 |
| WO | 2011061316 | A1 | 5/2011 |

* cited by examiner

SLIDING DOOR ROLLER SYSTEM

RELATED APPLICATIONS

This application claims priority to U.S. Provisional Patent App. No. 62/478,343 filed on Mar. 29, 2017, the entire disclosure of which is incorporated herein by reference.

BACKGROUND OF THE INVENTION

1. Field of the Invention

The present invention relates generally to sliding door roller systems. More specifically, the present invention relates to a side-adjustable sliding door roller system for a multi-panel door, such as a multi-panel glass door, which can be adjusted under the full load of the sash.

2. Description of Related Art

Sliding doors are used to provide ingress and egress from a building structure. Sliding doors having roller carriages allow the sliding door to slide on a track in the sill. Such door roller systems typically include a base or housing for supporting the door panel and one or more wheels or rollers coupled to the housing. Typically, door roller systems are adjustable to permit adjustment to the height or spacing of the housing relative to the wheels.

However, known door roller systems have several disadvantages. For example, known systems do not allow for height or spacing adjustment of the housing relative to the wheels or track while under load. Rather, it is required that the door position be compared to a predetermined benchmark, and if the door position does not match the benchmark, the door panel must be removed from the housing and the height or spacing of the housing is then adjusted before replacing the door panel and comparing the new door position to the benchmark, repeating this process if the new position still does not meet the benchmark. Other disadvantages include improper load distribution at the point of contact between the roller(s) and the track, and suboptimal load capacity and rigidity of the housing relative to the door panel secured thereto.

Therefore, there is a need for an improved sliding door roller system which allows for better load distribution and higher load capability, while permitting adjustment of the height or spacing of the housing relative to the track under load.

SUMMARY OF THE INVENTION

Bearing in mind the problems and deficiencies of the prior art, it is therefore an object of the present invention to provide an improved sliding door roller system which allows for adjustment of the height or spacing of the outer housing relative to the track or rail while under load.

It is another object of the present invention to provide an improved roller for use in a sliding door roller system which allows for improved load distribution at the point of contact between the roller and the track.

A further object of the present invention is to provide an improved outer housing for use in a sliding door roller system which allows for higher load capability and rigidity under full load of the door panel.

Still another object of the present invention is to provide an improved method of adjusting the height or spacing of the door panel relative to the track in a sliding door roller system.

Still other objects and advantages of the invention will in part be obvious and will in part be apparent from the specification.

The above and other objects, which will be apparent to those skilled in the art, are achieved in the present invention which is directed to a sliding door roller system comprising a roller housing including a pair of generally vertical side members, and a base portion connecting the side members and including a projection on an inner surface thereof, the roller housing at least partially disposed within an outer housing; at least one roller wheel rotatably coupled to the roller housing; an outer housing moveable relative to the roller housing and the at least one roller wheel in a direction perpendicular to a rotational axis of the at least one roller wheel; and a rotatable adjustment mechanism coupled to the roller housing and the outer housing. The adjustment mechanism is rotatable from an exterior of the outer housing and is adapted to index the outer housing relative to the roller housing in a plurality of height positions in situ under load of a panel secured to the outer housing.

The adjustment mechanism may comprise a rotatable control member and a non-circular cam coupled to a gear wheel, the cam in rotatable communication with the control member and rotatable about an axis transverse to the roller housing vertical side members. The cam has a peripheral edge comprising a plurality of teeth, the cam teeth cooperating with the roller housing inner surface projection to index the outer housing relative to the roller housing in a plurality of height positions as a result of rotation of the cam. The cam peripheral edge defines an increasing radius from a first position along the cam peripheral edge to a second position along the cam peripheral edge, wherein rotation of the cam from about the first position towards the second position indexes the outer housing away from the inner housing and rotation of the cam from about the second position towards the first position indexes the outer housing towards from the inner housing. The roller housing inner surface projection acts as a detent to prevent rotation of the cam while under load of the panel.

The adjustment mechanism rotatable control member may extend through at least a portion of the outer housing, such that the control member is rotatable from an exterior of the outer housing to rotate the cam to index the outer housing relative to the roller housing. The roller housing may comprise a vertical channel extending through a portion of each side member, wherein the adjustment mechanism control member extends within and is translatable in the channel as the outer housing is indexed relative to the roller housing as a result of rotation of the cam.

In an embodiment, the roller housing side members may define obtuse triangles having rounded corners, and the roller housing side members may further include a concave channel beginning at an obtuse angle of each inner housing side member and extending in a direction of a hypotenuse, wherein the adjustment mechanism control member extends within and is translatable in the channel as the outer housing is indexed relative to the roller housing as a result of rotation of the cam.

The roller housing base portion may be integrally formed with the pair of generally vertical side members, and the roller housing may form a generally U-shaped portion when viewed along an axis between the side members.

The outer housing may comprise a pair of generally vertical shell members, each shell member having a flange on an upper edge thereof extending in the direction of the opposing shell member. At least a portion of the shell member flanges may interlock to form a plane perpendicular to respective major surfaces of the vertical shell members, and the plane may further comprise a slot between the vertical shell member interlocking flanges and extending along a portion of a longitudinal axis of the outer housing. The adjustment mechanism rotatable control member may extend through apertures in the respective major surfaces of the vertical shell members, such that the control member is rotatable from an exterior of the outer housing to rotate the cam and gear wheel to index the outer housing relative to the roller housing.

The roller wheel may comprise an outer groove about a circumference thereof and an inner groove within the outer groove, wherein the inner groove is inset from the outer groove by a predetermined distance and has a diameter less than a diameter of the outer groove. The roller wheel is adapted to engage a track or rail only along the outer groove, distributing the load of the panel outwardly and concentrating the load along the outer groove.

In another aspect, the present invention is directed to a method of operating a sliding door roller system, comprising the steps of: providing a roller housing comprising a pair of generally vertical side members and an integral base portion including a projection on an inner surface thereof, the roller housing at least partially disposed within an outer housing; providing at least one roller wheel rotatably coupled to the roller housing; providing an outer housing moveable relative to the roller housing and the at least one roller wheel, the outer housing moveable in a direction perpendicular to a rotational axis of the at least one roller wheel; and providing a rotatable adjustment mechanism coupled to the roller housing and the outer housing, the adjustment mechanism rotatable from an exterior of the outer housing and adapted to index the outer housing relative to the roller housing in a plurality of height positions in situ under load of a panel secured to the outer housing. The method further comprises securing a panel to a top surface of the outer housing; and rotating the adjustment mechanism from the exterior of the outer housing to index the outer housing relative to the roller housing from a first height position to a second height position, the second height position being different from the first height position.

In an embodiment, the adjustment mechanism comprises a rotatable control member and a non-circular cam coupled to a gear wheel, the cam in rotatable communication with the control member and rotatable about an axis transverse to the roller housing vertical side members, the cam having a peripheral edge comprising a plurality of teeth, the cam teeth cooperating with the roller housing inner surface projection to index the outer housing relative to the roller housing in a plurality of height positions as a result of rotation of the cam, and the step of rotating the adjustment mechanism further comprises rotating the control member and cam to index the outer housing relative to the roller housing. The cam peripheral edge defines an increasing radius from a first position along the cam peripheral edge to a second position along the cam peripheral edge, wherein rotation of the cam from about the first position along the cam peripheral edge towards the second position along the cam peripheral edge indexes the outer housing away from the inner housing to the second height position, the second height position being greater than the first height position, and wherein rotation of the cam from about the second position along the cam peripheral edge towards the first position along the cam peripheral edge indexes the outer housing towards the inner housing to the second height position, the second height position being lower than the first height position.

The roller housing inner surface projection may act as a detent to prevent rotation of the cam while under load of the panel, and the method may further comprise the step of locking the outer housing in a desired height position relative to the roller housing by engaging one or more of the cam teeth with the roller housing inner surface projection.

In an embodiment, the roller wheel may comprise an outer groove about a circumference of the roller wheel and an inner groove within the outer groove, the inner groove being inset from the outer groove by a predetermined distance and having a diameter less than a diameter of the outer groove, and the method may further comprise the steps of: engaging a track or rail only along the at least one roller wheel outer groove as the sliding door roller system translates along the track or rail; and distributing the load of the panel outwardly and concentrating the load along the outer groove.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
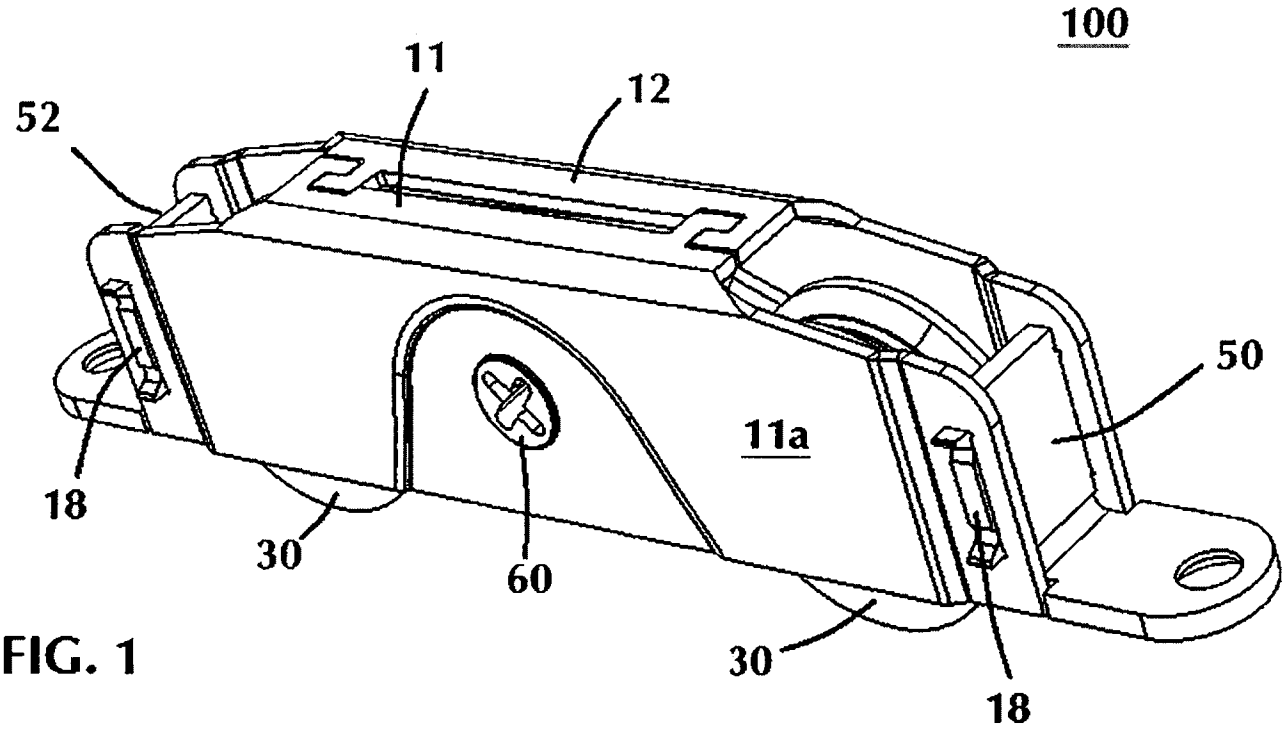
FIG. 1 is a perspective view of one embodiment of the sliding door roller system of the present invention, shown in a fully lowered state.
Figure 2:
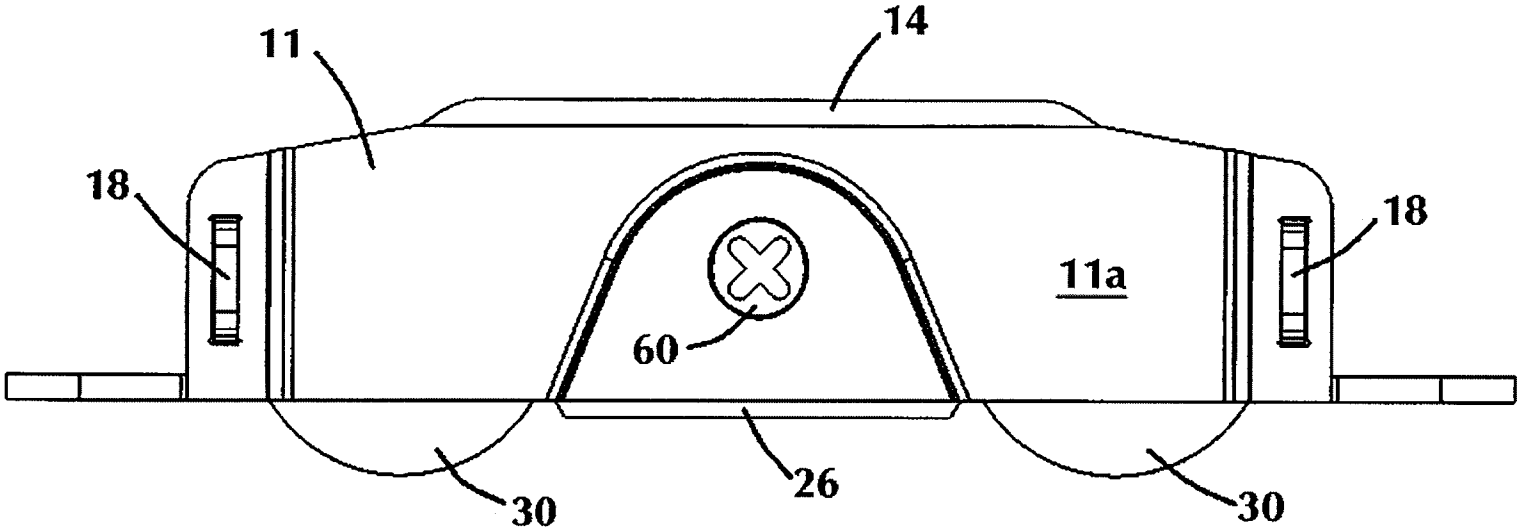
FIG. 2 is front, plan view of the sliding door roller system shown in FIG. 1.

In describing the embodiments of the present invention, reference will be made herein to FIGS. 1-13 of the drawings, in which like numerals refer to like features of the invention.

Certain terminology is used herein for convenience only and is not to be taken as a limitation of the invention. For example, words such as "upper," "lower," "left," "right," "horizontal," "vertical," "upward," "downward," "clockwise," or "counterclockwise" merely describe the configuration shown in the drawings. For purposes of clarity, the same reference numbers may be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

One embodiment of the sliding door roller system of the present invention is shown in FIGS. 1-13, inclusive. The sliding door roller system is configured to allow for or assist in moving a door or window panel, such as a multi-panel glass door, along a track or other rail pathway. Unlike conventional roller systems, the roller system of the present invention is adjustable while under load, to allow for changes in the height or spacing of the panel being supported by the roller system with respect to the track. The roller system includes a roller housing, at least one roller or wheel rotatably coupled to the roller housing, an outer housing, and an adjustment mechanism coupled to the roller housing and outer housing for adjusting the height of the outer housing with respect to the roller housing and track or rail.

Figure 3:
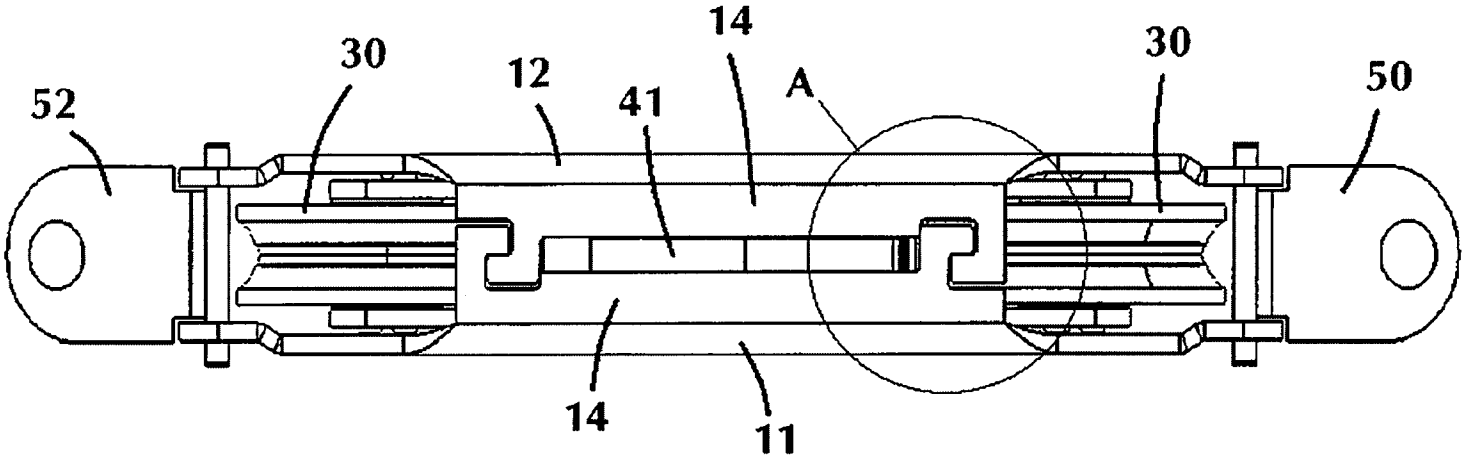
FIGS. 3 and 3A are a top plan view, and magnified view, respectively, of the sliding door roller system shown in FIG. 1.
Figure 3A:
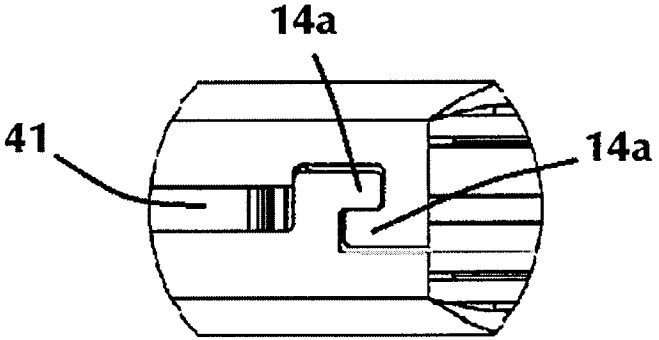

Referring now to FIG. 1, an embodiment of the sliding door roller system 100 of the present invention is shown. The system includes an outer housing or shell 10 (as best shown in FIG. 6) within which a roller housing or carriage 20 (FIG. 5) is at least partially disposed. As shown in FIG. 1, outer housing or shell 10 comprises a pair of generally vertical side members or shell members 11, 12 connected by non-integral end members 50, 52. The end members include tabs 18 that extend within slots 15 in the shell members, and are secured therein by known methods, such as riveting. Other methods of securing the end members to the shell members may also be used. In other embodiments, the end members may be integrally formed with the side members 11, 12 to form the outer housing or shell 10. As best seen in FIG. 6, each shell member includes a flange 14 at a top edge 13 thereof that extends approximately perpendicular to the major surface 11*a*, 12*a* of each shell member in the direction of the opposing shell member. In contrast to conventional housings of roller systems of the prior art, the flanges of the respective side members each have a keyed portion 14*a* or are otherwise interlocked to form a plane approximately perpendicular to the major surfaces of the respective shell members (FIGS. 3 and 3A). As shown in at least FIGS. 1, 3 and 6, the plane formed by the interlocking flanges may comprise a slot or opening 16 approximately centered between the pair of vertical side members 11, 12. The interlocking flanges provide higher rigidity of the outer housing or shell, and increased load capacity over roller systems of the prior art, when a panel is secured thereto.

Figure 5:
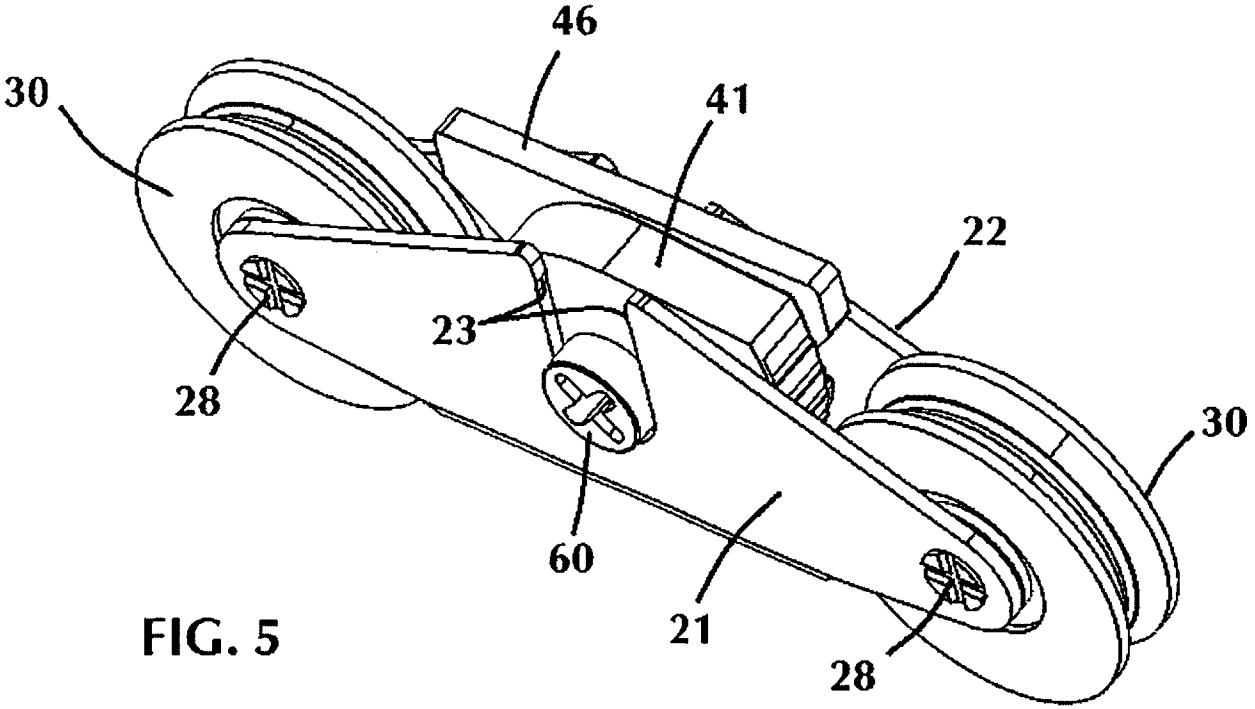
FIG. 5 is a perspective view of the sliding door roller system shown in FIG. 1, with a front portion of the outer housing removed.
Figure 6:
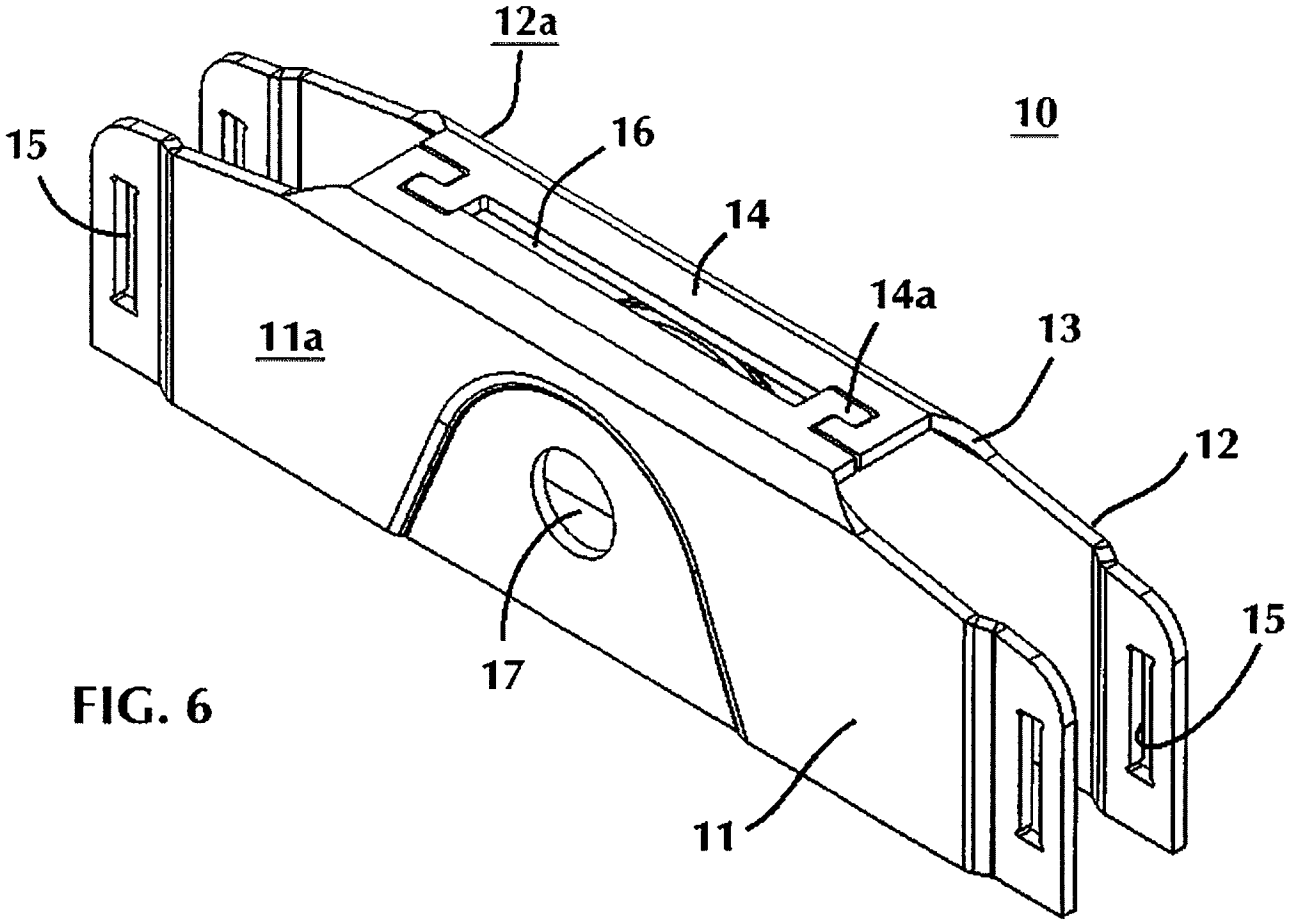
FIG. 6 is a perspective view of an embodiment of the outer housing of the sliding door roller system of the present invention.
Figure 12A:
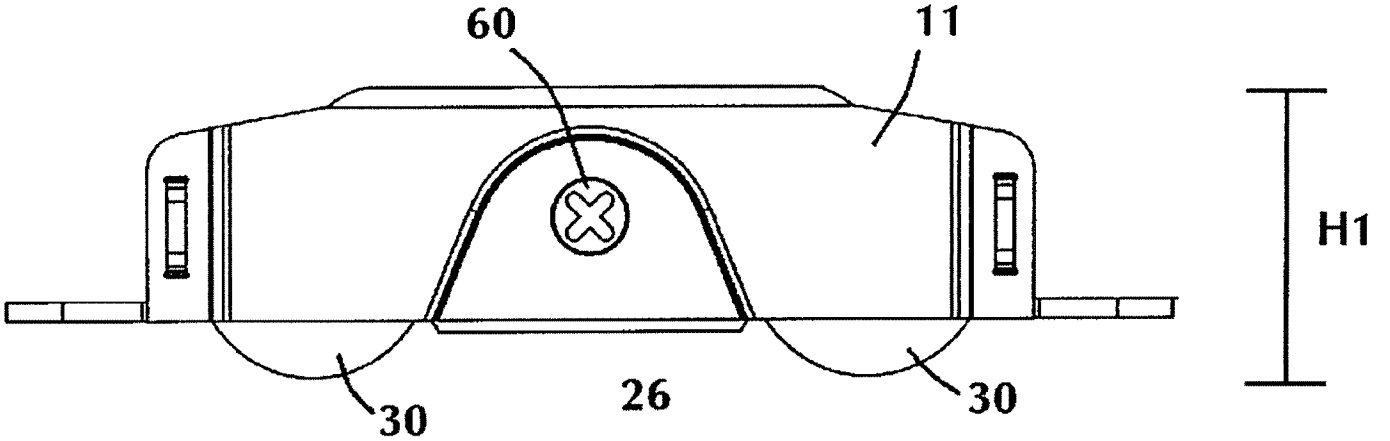
FIGS. 12A-12B are side plan views of an embodiment of the sliding door roller system of the present invention, shown in a fully lowered state (FIG. 12A) and a fully extended state (FIG. 12B).
Figure 12B:
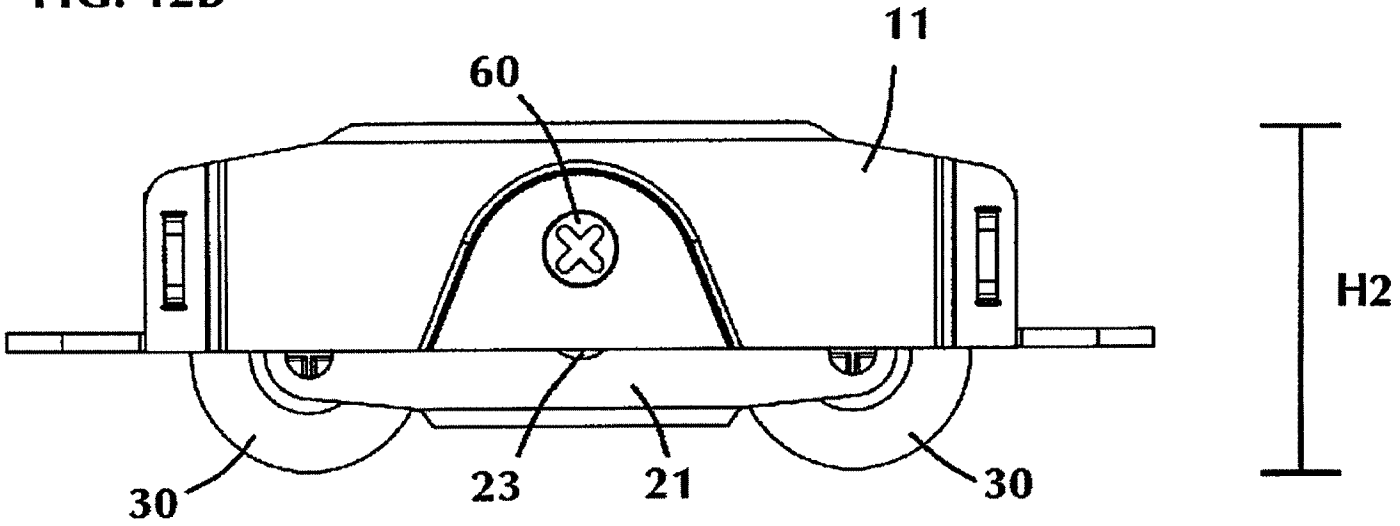
Figure 13:
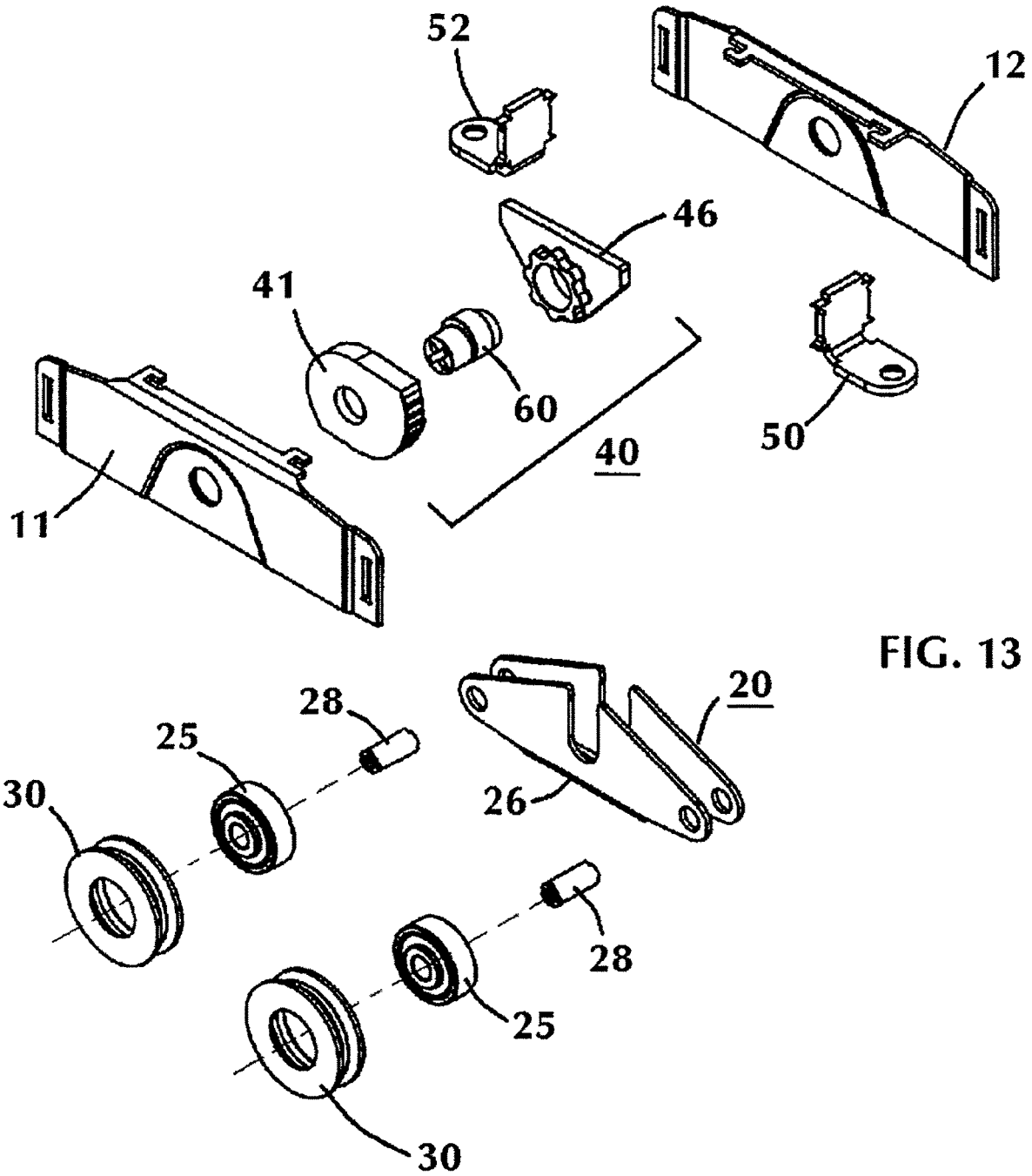
FIG. 13 is an exploded view of an embodiment of the sliding door roller system of the present invention.

The roller system of the present invention further includes an inner roller housing or carriage 20, within which at least one roller or wheel 30 is disposed, as shown in FIG. 5. Inner housing 20 is adjustable within and with respect to the outer housing 10 by a rotatable adjustment mechanism 40 coupled to the roller housing and outer housing, as will be described in more detail below. Such adjustment changes the height or spacing of the outer housing and door panel supported by the roller system, with respect to the track or rail (FIGS. 12A-12B).

Figure 4:
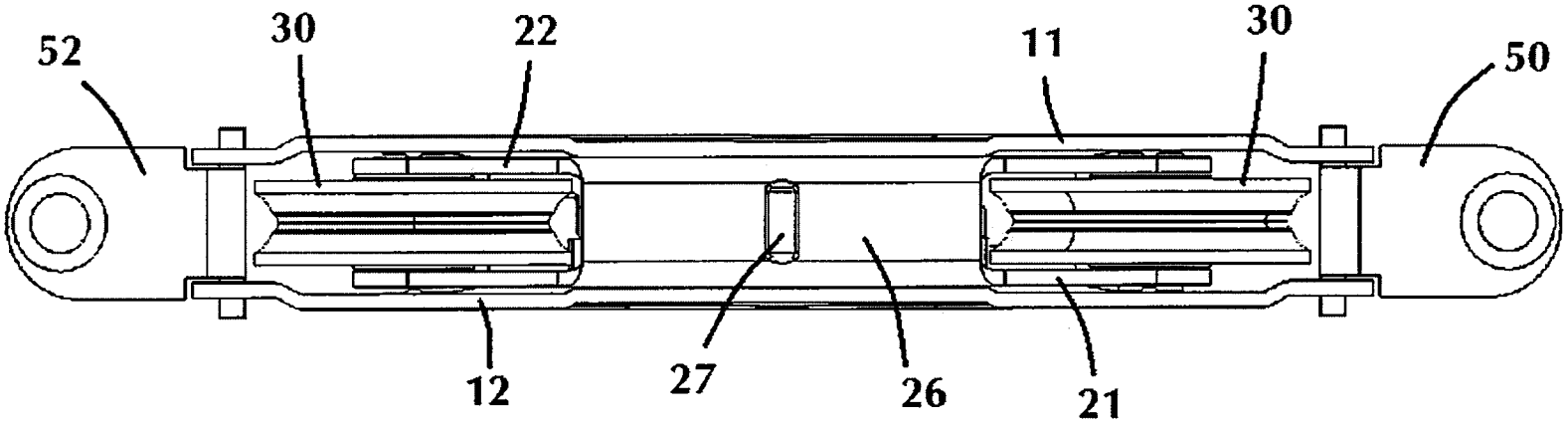
FIG. 4 is a bottom plan view of the sliding door roller system shown in FIG. 1.
Figure 10:
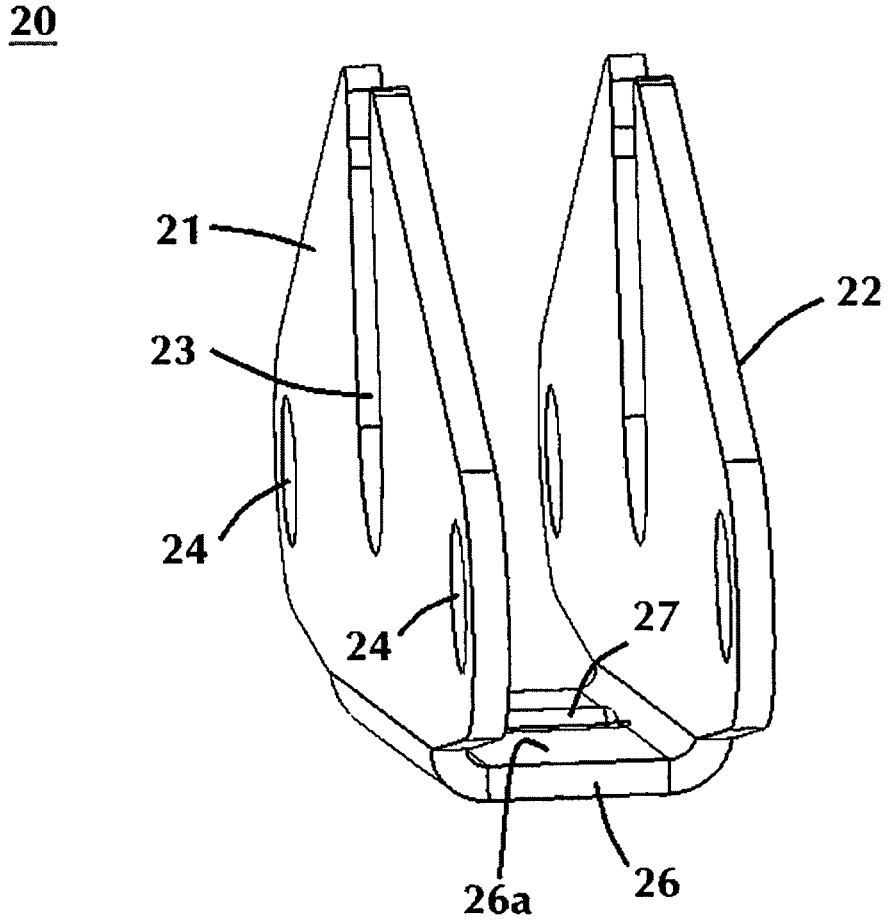
FIG. 10 is a perspective view of an embodiment of the inner housing of the sliding door roller system of the present invention.

Roller housing or carriage 20 comprises a pair of generally vertical side members 21, 22 connected by an integral base portion 26. In contrast to roller systems of the prior art, which typically include a two (or more) piece roller housing, the inner housing of the present invention may be a one piece housing forming a generally U-shape when viewed along an axis between the vertical side members. Base portion 26 includes a bump or projection 27 on an inner surface 26*a* thereof, at an approximate midpoint along the length of the base portion (FIGS. 4 and 10). In an embodiment, as best shown in FIG. 5, the inner housing side members 21, 22 may define obtuse triangular plates having rounded corners. Within each side member is a concave portion or channel 23 beginning at the obtuse angle of the side member and extending in the direction of the hypotenuse. As will be described below, a control member 60 extends within channel 23 and translates or moves vertically up and down within the channel in response to actuation of an adjustment mechanism 40 to adjust the height or spacing of the panel with respect to the roller housing 20. Each side member 21, 22 further includes at least one aperture 24 for receiving a bearing and fastener 25, 28 extending therethrough to rotatably secure a roller or wheel to the roller housing (FIGS. 5 and 10).

Figure 11:
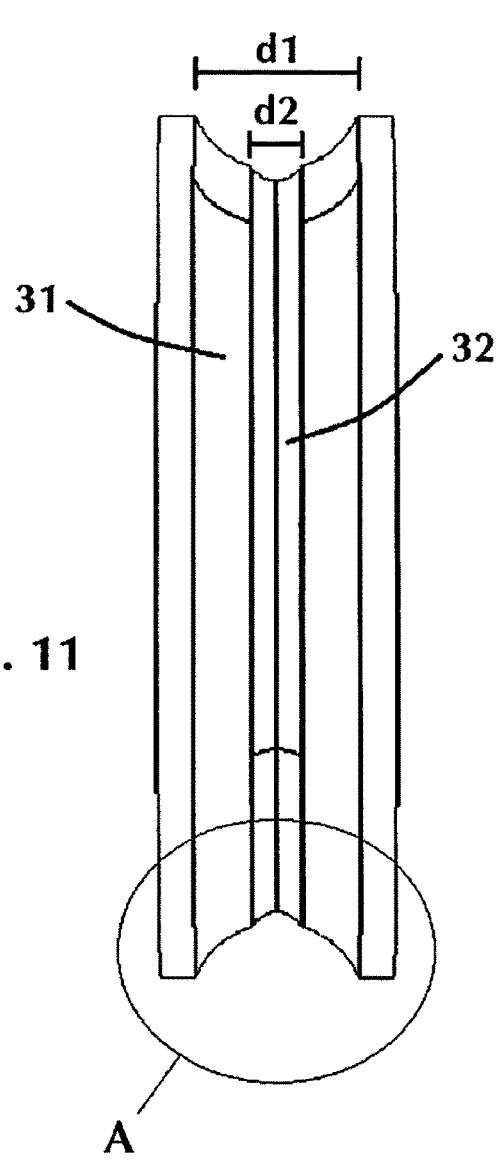
FIGS. 11 and 11A are a side view, and magnified view, respectively, of a roller wheel according to an embodiment of the sliding door roller system of the present invention.
Figure 11A:
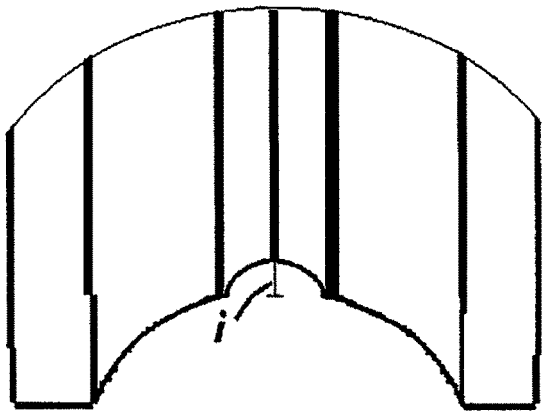

As shown in FIG. 5, at least one roller or wheel 30 is mounted within and generally surrounded by the roller housing. Each roller includes an outer groove or recess 31 about a circumference of the roller to engage a track or rail, and an inner groove 32 at an approximate midpoint within the outer groove about the circumference of the roller (FIG. 11). Inner groove 32 is inset from the outer groove 31 and has a diameter d2 less than a diameter d1 of the outer groove. In a typical roller of the prior art, the roller has one point of contact with the track or rail at the approximate midpoint of the profile of the roller or wheel, which concentrates the load at one specific point. By contrast, the roller 30 of the present invention provides an outer groove defining the profile of the wheel or roller, which presents an additional point of contact between the roller and the track over that of the prior art, allowing for improved load distribution. As best seen in the magnified view of FIG. 11A, inner groove 31 is inset at a predetermined distance i from the outer groove 31, such that the roller wheel will contact the rail only along the outer groove throughout translation of the roller system along the rail or track, distributing the load outwardly. The inset inner groove 32 acts to provide additional load relief by concentrating the load along multiple points of contact on the outer groove, as the inner groove does not contact the track or rail.

Figure 7:
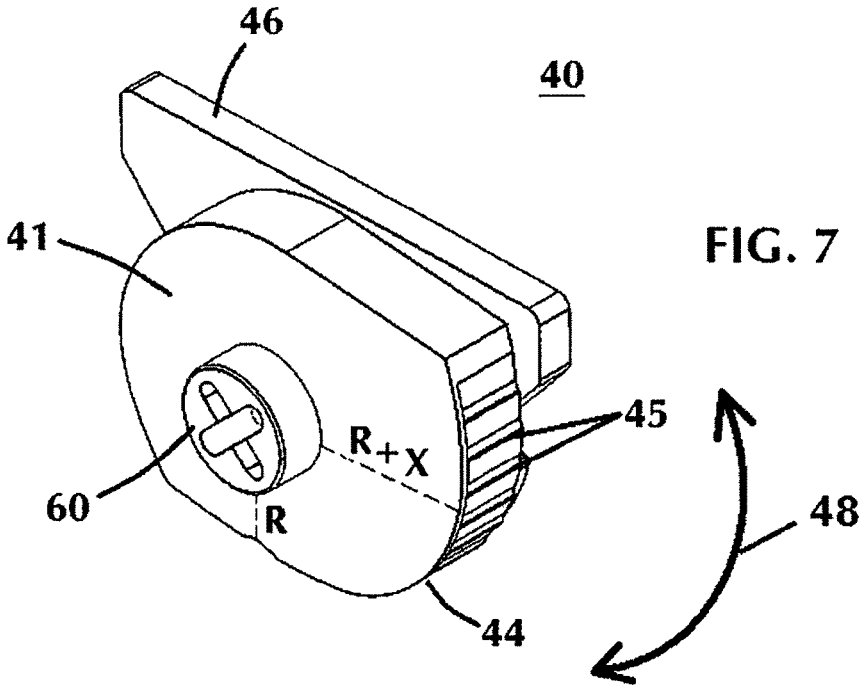
FIG. 7 is a perspective view of an embodiment of the cam and gear plate of the sliding door roller system of the present invention.
Figure 8:
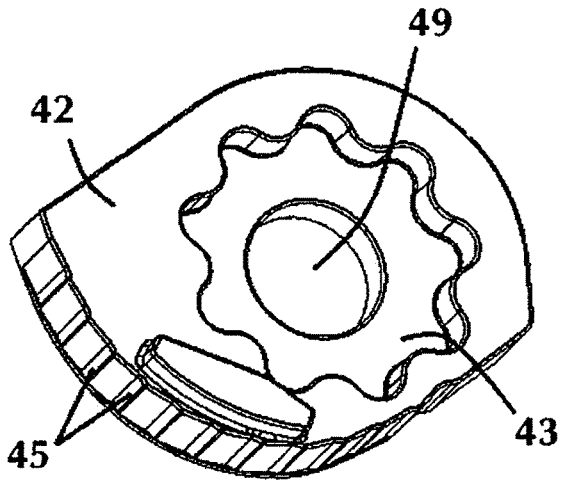
FIG. 8 is perspective view of the mating face of the cam shown in FIG. 7.
Figure 9:
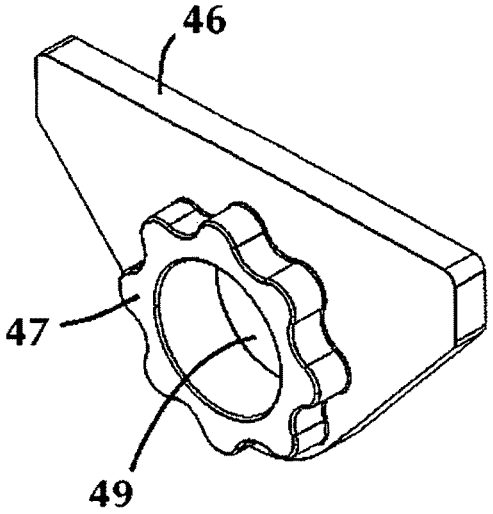
FIG. 9 is a perspective view of the mating face of the gear plate shown in FIG. 7.

Coupled to the outer housing or shell 10 and the inner roller housing 20 is a rotatable adjustment mechanism 40 for adjusting the height or spacing of the outer housing and panel with respect to the roller housing and rail or track. As shown in FIGS. 7-9, the adjustment mechanism may comprise a non-circular cam 41 coupled to a gear plate 46 and rotatable about an axis transverse to the vertical side members of the roller housing, and a control member 60 which is in rotatable communication with the cam. Cam 41 includes a peripheral surface 44 having a plurality of teeth 45, wherein the peripheral surface defines an increasing radius R from a first position to a second position along the peripheral surface, when viewed in a counterclockwise direction (as shown in FIG. 7). In connection with the bump or projection 27 on the inner surface 26*a* of the roller housing base portion (FIGS. 4 and 10), the variable radius of the cam 41 and cam teeth 45 operates to index the outer housing 10 relative to the inner roller housing or carriage 20 in a plurality of height positions.

As shown in FIGS. 8 and 9, cam 41 has on a rear surface 42 a depression 43 within which gear wheel 47 is disposed, such that the cam is rotationally locked with the gear plate 46. Aperture 49 extends through both gear plate 46 and cam 41 for receiving control member 60 to adjust the height or spacing of the outer housing 10 with respect to the roller and track or rail.

A control member 60, such as a rotatable fastener, extends transversely through the sliding door roller system for adjusting the height or spacing of the panel. More specifically, control member 60 extends through apertures 17 in outer housing vertical side members 11, 12, through the concave portion 23 of the inner housing vertical side members 21, 22, and through aperture 49 in the cam and gear plate, respectively, such that the control member may be adjusted or rotated from the exterior of either side of the outer housing 10 (FIG. 1). Adjustment of the control member, i.e. rotation of the fastener, rotates the cam 41 disposed within the roller housing in either a clockwise or counterclockwise direction (represented in FIG. 7 by arrow 48), such that the variable radius of the cam and cam teeth 45, in cooperation with the projection 27 at the base of the roller housing, operate to index the outer housing 10 relative to the inner roller housing 20 between desired height positions.

For example, rotation of the control member or fastener 60 in a clockwise direction (with reference to FIGS. 12A and 12B) rotates the cam 41 towards its increasing radii R+X (FIG. 7), thereby stepping or indexing the outer housing 20 away from the inner housing and increasing the height of the panel being supported with respect to the track. Conversely, rotation of the control member 60 in a counterclockwise direction will rotate the cam 41 towards its decreasing radii R, thereby bringing the inner housing and outer housing closer and decreasing the height of the outer housing (and panel) with respect to the track or rail. FIG. 12A shows the outer housing 10 in a fully lowered state (i.e. cam 41 is rotated completely in a counterclockwise direction) having a height H1, while FIG. 12B shows the outer housing in a fully extended state (i.e. cam 41 is rotated completely in a clockwise direction) having a height H2, which is greater than H1. In one embodiment, H1 may be about 1.5 inches (38.1 mm) and H2 may be about 1.75 inches (44.45 mm). It should be understood by those skilled in the art that the height differential between H1 and H2 may be greater than or less than 0.25 inches (6.35 mm), in accordance with manufacturing tolerances and design requirements. As the cam is rotated, control member 60 translates vertically up or down within channel 23 as the outer housing 10 is stepped away from or towards the rail or track, as shown in the transition from FIG. 12A to 12B. The rail or track is not shown in either FIG. 12A or 12B, for clarity.

When the adjustment mechanism 40 and control member 60 is not under rotation, bump or projection 27 on the inner surface 26*a* of the roller housing base portion acts as a detent to prevent the cam from rotating under the load of the panel. An advantage of the system of the present invention is that the height of the outer housing may be adjusted under the full load of the panel, rather than requiring removal of the panel and adjustment of the outer housing to meet a benchmark, as in prior art sliding roller systems.

Thus the present invention achieves one or more of the following advantages. The roller system of the present invention allows for the adjustment of the height or spacing of the panel relative to the roller and rail or track while under full load of the panel, thereby eliminating the requirement of prior art roller systems that the door panel be removed and the height or spacing of the housing adjusted before replacing the door panel and comparing the new door position to a predetermined to a predetermined benchmark. The present invention further allows for higher load capability, as a result of the interlocking or keyed flanges connecting the outer housing or shell, and better load distribution at the roller or wheel due to the outer and inset inner roller groove configuration.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A sliding door roller system comprising:

a roller housing comprising a pair of generally vertical side members and an integral base portion including a projection on an inner surface thereof, the roller housing at least partially disposed within an outer housing;

at least one roller wheel rotatably coupled to the roller housing;

the outer housing moveable relative to the roller housing and the at least one roller wheel, the outer housing moveable in a direction perpendicular to a rotational axis of the at least one roller wheel, the outer housing comprising a pair of generally vertical shell members each having a flange on an upper edge thereof extending in the direction of the opposing shell member to form a plane perpendicular to respective major surfaces of the vertical shell members, at least a portion of the shell member flanges being interlocked or keyed to prevent relative rotation between the opposing shell members when under load of a panel secured to the outer housing, and further comprising a slot between said vertical shell member flanges and extending along a portion of a longitudinal axis of the outer housing; and a rotatable adjustment mechanism coupled to the roller housing and the outer housing, the adjustment mechanism rotatable from an exterior of the outer housing and adapted to index the outer housing relative to the roller housing in a plurality of height positions in situ under load of the panel secured to the outer housing.

2. The sliding door roller system of claim 1 wherein the adjustment mechanism comprises a rotatable control member and a non-circular cam coupled to a gear wheel, the cam in rotatable communication with the control member and rotatable about an axis transverse to the roller housing vertical side members, the cam having a peripheral edge comprising a plurality of teeth, the cam teeth cooperating with the roller housing inner surface projection to index the outer housing relative to the roller housing in a plurality of height positions as a result of rotation of the cam.

3. The sliding door roller system of claim 2 wherein the cam peripheral edge defines an increasing radius from a first position along the cam peripheral edge to a second position along the cam peripheral edge, wherein rotation of the cam from about the first position towards the second position indexes the outer housing away from the inner housing; and wherein rotation of the cam from about the second position towards the first position indexes the outer housing towards the inner housing.

4. The sliding door roller system of claim 2 wherein the adjustment mechanism rotatable control member extends through at least a portion of the outer housing, the control member rotatable from an exterior of the outer housing to rotate the cam to index the outer housing relative to the roller housing.

5. The sliding door roller system of claim 2 wherein the roller housing comprises a vertical channel extending through a portion of each side member, the adjustment mechanism control member extending within and translatable in the channel as the outer housing is indexed relative to the roller housing as a result of rotation of the cam.

6. The sliding door roller system of claim 2 wherein the roller housing side members define obtuse triangles having rounded corners.

7. The sliding door roller system of claim 6 further comprising a concave channel beginning at an obtuse angle of each inner housing side member and extending in a direction of a hypotenuse, the adjustment mechanism control member extending within and translatable in the channel as the outer housing is indexed relative to the roller housing as a result of rotation of the cam.

8. The sliding door roller system of claim 2 wherein the roller housing inner surface projection acts as a detent to prevent rotation of the cam while under load of the panel.

9. The sliding door roller system of claim 1 wherein the adjustment mechanism rotatable control member extends through apertures in the respective major surfaces of the vertical shell members, the control member rotatable from an exterior of the outer housing to rotate the cam and gear wheel to index the outer housing relative to the roller housing.

10. A sliding door roller system comprising:

a roller housing comprising a pair of generally vertical side members and an integral base portion including a projection on an inner surface thereof, the roller housing at least partially disposed within an outer housing;

at least one roller wheel rotatably coupled to the roller housing, the at least one roller wheel comprising an outer groove about a circumference of the roller wheel and an inner groove within the outer groove, the inner groove being inset from the outer groove by a predetermined distance and having a diameter less than a diameter of the outer groove;

the outer housing moveable relative to the roller housing and the at least one roller wheel, the outer housing moveable in a direction perpendicular to a rotational axis of the at least one roller wheel; and a rotatable adjustment mechanism coupled to the roller housing and the outer housing, the adjustment mechanism rotatable from an exterior of the outer housing and adapted to index the outer housing relative to the roller housing in a plurality of height positions in situ under load of a panel secured to the outer housing.

11. The sliding door roller system of claim 10 wherein the at least one roller wheel is adapted to engage a track or rail only along the outer groove, distributing the load of the panel outwardly and concentrating the load along the outer groove.

12. A method of operating a sliding door roller system, comprising the steps of:

providing a roller housing comprising a pair of generally vertical side members and an integral base portion including a projection on an inner surface thereof, the roller housing at least partially disposed within an outer housing;

providing at least one roller wheel rotatably coupled to the roller housing, the at least one roller wheel comprising an outer groove about a circumference of the roller wheel and an inner groove within the outer groove, the inner groove being inset from the outer groove by a predetermined distance and having a diameter less than a diameter of the outer groove;

providing the outer housing, the outer housing moveable relative to the roller housing and the at least one roller wheel, the outer housing moveable in a direction perpendicular to a rotational axis of the at least one roller wheel;

providing a rotatable adjustment mechanism coupled to the roller housing and the outer housing, the adjustment mechanism rotatable from an exterior of the outer housing and adapted to index the outer housing relative to the roller housing in a plurality of height positions in situ under load of a panel secured to the outer housing;

securing a panel to a top surface of the outer housing; and rotating the adjustment mechanism from the exterior of the outer housing to index the outer housing relative to the roller housing from a first height position to a second height position, the second height position being different from the first height position.

13. The method of claim 12 wherein the adjustment mechanism comprises a rotatable control member and a non-circular cam coupled to a gear wheel, the cam in rotatable communication with the control member and rotatable about an axis transverse to the roller housing vertical side members, the cam having a peripheral edge comprising a plurality of teeth, the cam teeth cooperating with the roller housing inner surface projection to index the outer housing relative to the roller housing in a plurality of height positions as a result of rotation of the cam, and wherein the step of rotating the adjustment mechanism further comprises:

rotating the control member and cam to index the outer housing relative to the roller housing.

14. The method of claim 13 wherein the cam peripheral edge defines an increasing radius from a first position along the cam peripheral edge to a second position along the cam peripheral edge, wherein rotation of the cam from about the first position along the cam peripheral edge towards the second position along the cam peripheral edge indexes the outer housing away from the inner housing to the second height position, the second height position being greater than the first height position; and wherein rotation of the cam from about the second position along the cam peripheral edge towards the first position along the cam peripheral edge indexes the outer housing towards the inner housing to the second height position, the second height position being lower than the first height position.

15. The method of claim 13 wherein the adjustment mechanism rotatable control member extends through at least a portion of the outer housing, the control member rotatable from an exterior of the outer housing to rotate the cam to index the outer housing relative to the roller housing.

16. The method of claim 13 wherein the roller housing comprises a vertical channel extending through a portion of each side member, the adjustment mechanism control member extending within and translatable in the channel as the outer housing is indexed relative to the roller housing as a result of rotation of the cam.

17. The method of claim 13 wherein the roller housing inner surface projection acts as a detent to prevent rotation of the cam while under load of the panel, and further comprising the step of:

locking the outer housing in a desired height position relative to the roller housing by engaging one or more of the cam teeth with the roller housing inner surface projection.

18. The method of claim 13 further comprising the steps of:

engaging a track or rail only along the at least one roller wheel outer groove as the sliding door roller system translates along the track or rail; and distributing the load of the panel outwardly and concentrating the load along the outer groove.

* * * * *